US005134957A

United States Patent [19]

Nobili

[11] Patent Number: 5,134,957

[45] Date of Patent: Aug. 4, 1992

[54] CONTINUOUS DISTRIBUTOR FOR SINGLE HYGIENIC SAMPLES OF COSMETIC PRODUCTS

[75] Inventor: Renato Nobili, Milan, Italy

[73] Assignee: Nobili s.r.l., Lesmo, Italy

[21] Appl. No.: 559,360

[22] Filed: Jul. 30, 1990

[30] Foreign Application Priority Data

Aug. 4, 1989 [IT] Italy ..... 21594 B/89

[51] Int. Cl.[5] ..... B05C 3/18

[52] U.S. Cl. ..... 118/43; 118/235; 118/415; 118/419; 118/428; 221/96; 221/135; 239/37

[58] Field of Search ..... 118/37, 43, 109, 209, 118/235, 264, 267, 268, 415, 419, 428; 221/93, 96, 123, 135; 239/37, 44, 47, 52

[56] References Cited

U.S. PATENT DOCUMENTS

| | | | |
|---|---|---|---|
| 1,708,701 | 4/1929 | McHenry | 118/43 |
| 2,209,266 | 7/1940 | Goldstein | 118/209 |
| 2,302,179 | 11/1942 | Bronfman | 118/43 |
| 2,348,067 | 5/1944 | Hoitt | 118/209 |
| 2,737,149 | 3/1956 | Collins et al. | 118/43 |
| 3,310,353 | 3/1967 | Cordis | 118/43 |
| 3,592,161 | 7/1971 | Hoffmann | 118/43 |
| 4,069,789 | 1/1978 | Fukagawa et al. | 118/43 |
| 4,519,308 | 5/1985 | Ebele | 221/135 |
| 4,566,606 | 1/1986 | Kung | 221/135 |
| 4,984,530 | 1/1991 | Dutton | 118/235 |

*Primary Examiner*—Richard L. Chiesa
*Attorney, Agent, or Firm*—Herbert Dubno

[57] ABSTRACT

A dispenser for containing and dispensing samples of a cosmetic product delivered by a roll of paper emerging from the dispenser in a predetermined sequence includes a housing for use with a C-shaped flange and a lid provided with a respective C-shaped flange juxtaposed with the flange of the housing having studs preventing the emerge of the paper above a predetermined length.

8 Claims, 4 Drawing Sheets

CONTINUOUS DISTRIBUTOR FOR SINGLE HYGIENIC SAMPLES OF COSMETIC PRODUCTS

FIELD OF THE INVENTION

This invention relates to a sealed distributor for single test samples of cosmetic products.

BACKGROUND OF THE INVENTION

It is customary, before acquiring a cosmetic product such as loose powders, powder, paste, lipstick and so on, for the user to carry out a test of the product directly on the skin and/or lips to determine the exact shade of color and/or consistency of the product when applied.

For this purpose there are therefore placed at the disposal of the user, by the vendor, samples of the product which are used by successive, different users for testing, until the sample is exhausted.

It is evident that this involves serious hygienic risks, in that the same product is brought into contact with the skins of different users, who are not known to one another.

OBJECTS OF THE INVENTION

It is therefore a principal object of the invention to provide an apparatus producing disposable test samples of cosmetic products used once only and by only one user, then to be thrown away.

Still another object of the invention is to provide an apparatus with a sealed distributor and inaccessible from outside, so that samples may be distributed in a simple and inexpensive manner with the maximum guarantee of hygiene for the user.

Yet another object is to provide a dispensing apparatus for displaying the characteristics of the product.

SUMMARY OF THE INVENTION

These objects are attained in a distributor for samples of beauty products, cosmetic products and the like, such as loose powders, powder, pastes, creams, lipsticks and the like, the distributor being composed of a box containing a roll of strip paper or the like, or of folded napkins, the free edge of which emerges to the outside through an aperture provided with a projecting flange, the box being closed at the top by a lid, the lid in turn being equipped with a corresponding projecting flange.

Between the box and the lid carrying a transparent tray containing the product to be tested, the edge of the paper or similar strip is pressed by a pad or the like integral with an elastic means disposed beneath the emerging strip edge in such manner that the product contained in the tray above is transferred by friction onto the paper strip during the operation of extracting carried out by the user by pulling the edge of the strip from the outside. The section carrying the sample of the product can be separated by tearing off and kept by the user for the desired use and checking.

Preferably, the projecting flange of the box has a C-shape and the projecting flanges of box and lid constitute, when placed one above another, a slit for communication between inside and outside of the box, which allows the paper strip to emerge and prevents access to the product within by the user.

It is also provided that the front wall of the box be able to be opened as a door and may be transparent and/or provided with a contents indicator for replacement of the contents when they are exhausted. Furthermore, the transparent tray into which the product is pressed may be snap-fitted and/or replaced according to the product to be displayed.

In the distributor according to the present invention, the strip of paper or the like or the folded napkins or the like may be preprinted and equipped with transverse prerupture lines for the separation of the pulled-out edges, as well as with pairs of holes disposed along the lateral edges of the strip at uniform intervals from the transverse rupture lines, and between the projecting flanges of the box and the lid there are interposed studs having preferably spherical tops suitable for engaging with the pairs of holes for the purpose for exerting a frictions action in the longitudinal direction, so as to assist tearing off of the strip along the transverse prerupture lines.

Advantageously the distributor is for use with the discharge of the edge of the strip produced by manual and/or automatic actuation. In particular, the manual actuation may preferably be achieved by a pair of rollers, disposed in proximity to the slit and able to be rotated from the outside by a lever, crank or the like.

BRIEF DESCRIPTION OF THE DRAWING

These and other objects, features and advantages will become more readily apparent from the following description, reference being made to the accompanying drawing in which.

SPECIFIC DESCRIPTION

Figure 1:
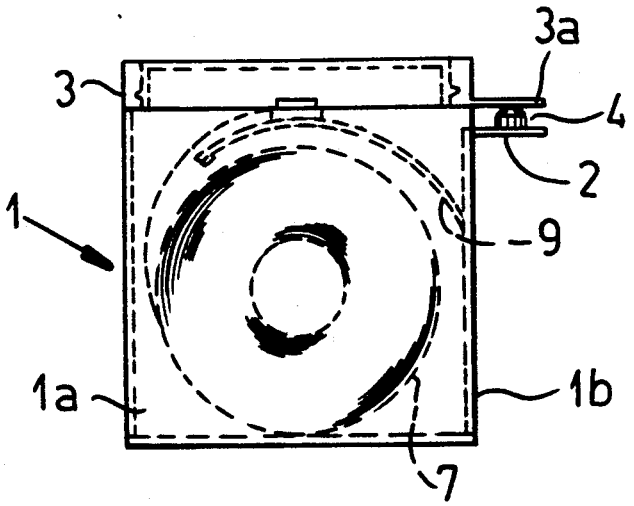
FIG. 1 is a front view of the distributor, with the front wall being transparent, and with a roll of strip paper.

With reference to FIG. 1, the distributor for samples of products indicated above comprises an open-topped, box-shaped casing 1, comprising a front wall la, side walls 1*d*, one of which is a hinged door which allows access to the interior of the box and a wall adjacent to the door and bent over at the top to form a flange 2, projecting outwards and a bottom side 1*e*.

The flange 2 has substantially a C-shape, the parallel sides of which project outwardly, and on each of which there is present a stud 2*b*, having a spherical upper surface.

The box 1 can be closed at the top by means of a lid 3, in turn equipped with a projecting flange 3*a* which, when the box is closed, is in light contact with the top of the spherical surfaces of the studs 2*b*, thus forming together with the flange 2 an open slit 4, which provides communication between the inside and the outside of the box.

Figure 2:
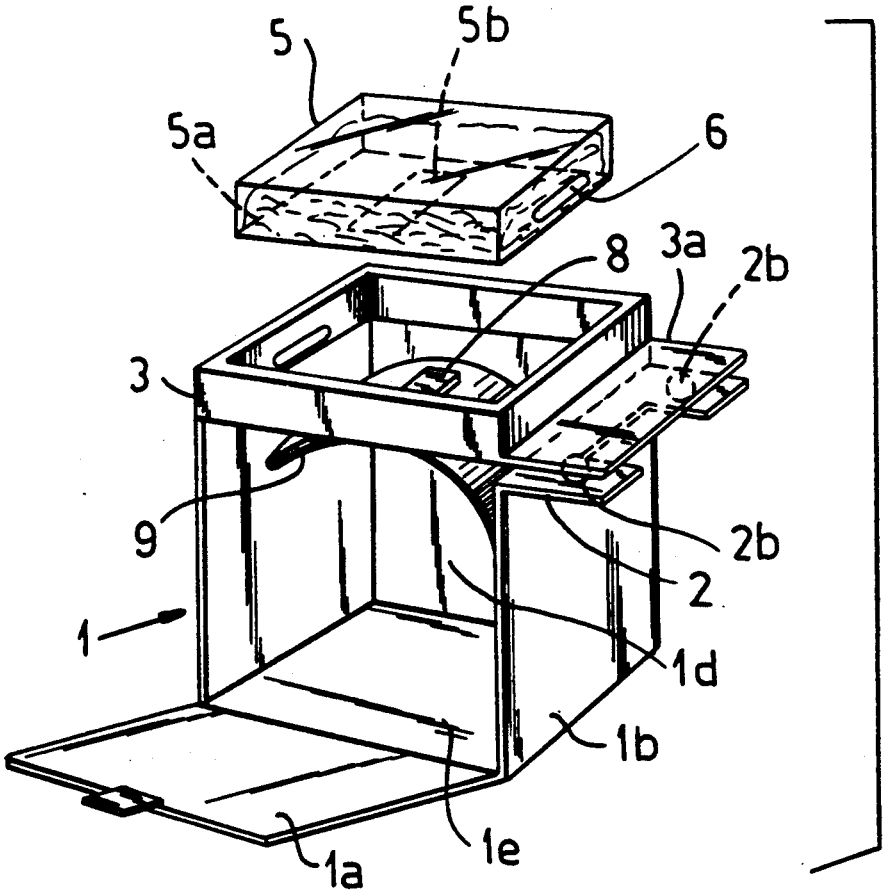
FIG. 2 is an exploded perspective view of the distributor according to FIG. 1.
Figure 3:
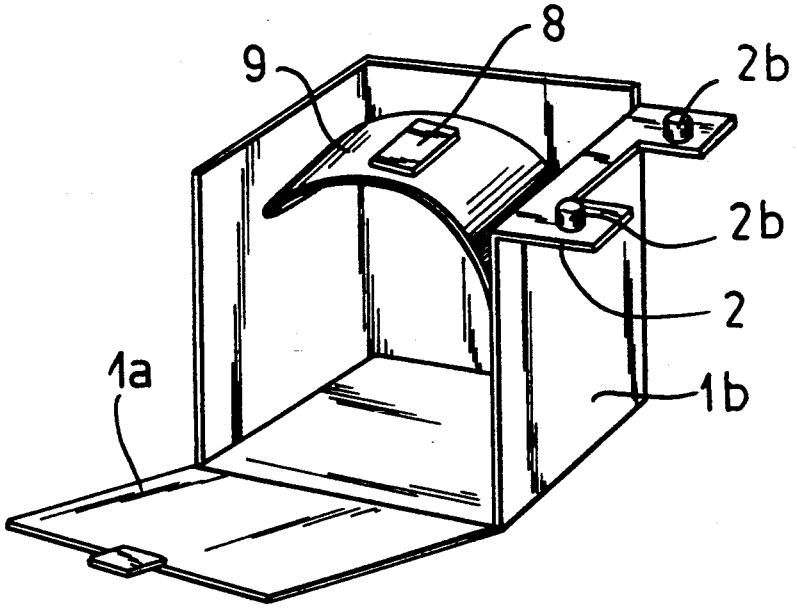
FIG. 3 is a perspective view according to FIG. 1.

Between the box 1 and the lid 3 there can be inserted a transparent tray 5 (FIG. 2), into which is pressed the product 5*a* to be dispensed for testing (commonly known as a GODET), which tray remains blocked to the side walls of the box 1 by back-cut zones 6 for snap engagement.

Figure 7:
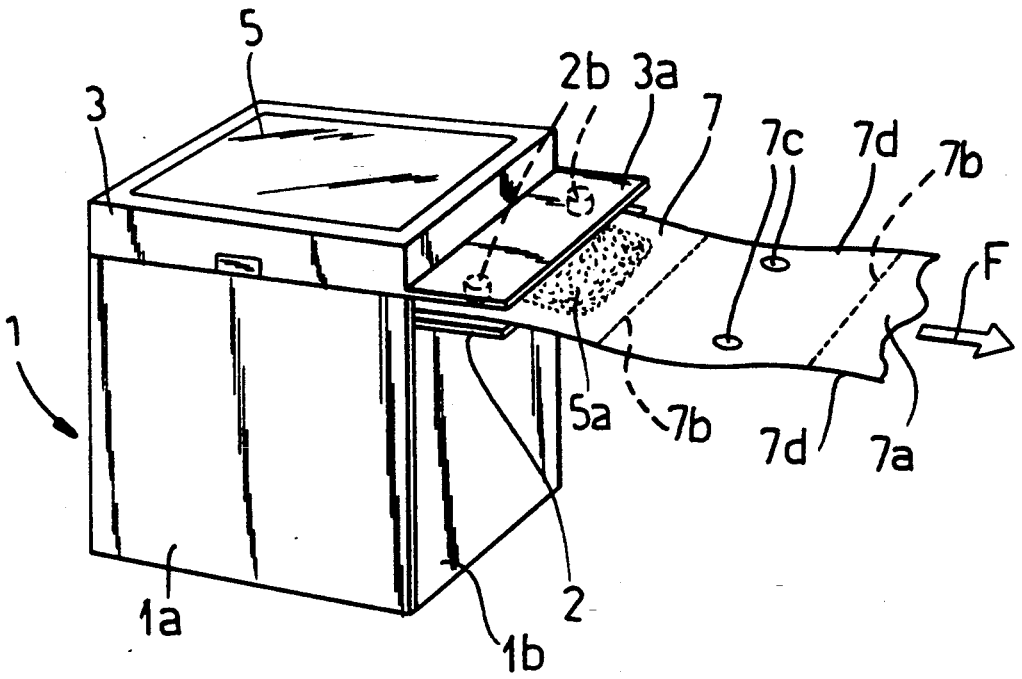
FIG. 7 is a perspective view of the distributor with the strip partly pulled out, showing the prerupture lines and the engagement holes.

Inside the box 1 there is inserted a roll of prestamped strip paper or the like 7, of which the free edge 7a can emerge from said slit 4, the strip being equipped (FIG. 7) with prerupture lines 7b and pairs of holes 7c disposed at uniform intervals from the prerupture lines 7b and at such a distance from the lateral edges 7d as to come into engagement with the studs 2b when the strip 7 is unrolled towards the outside.

The tray 5 possesses an open window 5b in the lower part, corresponding to a felt pad 8 (FIG. 2) supported by a strip spring 9, blocked against the box 1 and elastically biased to rise towards the tray 5.

Figure 4:
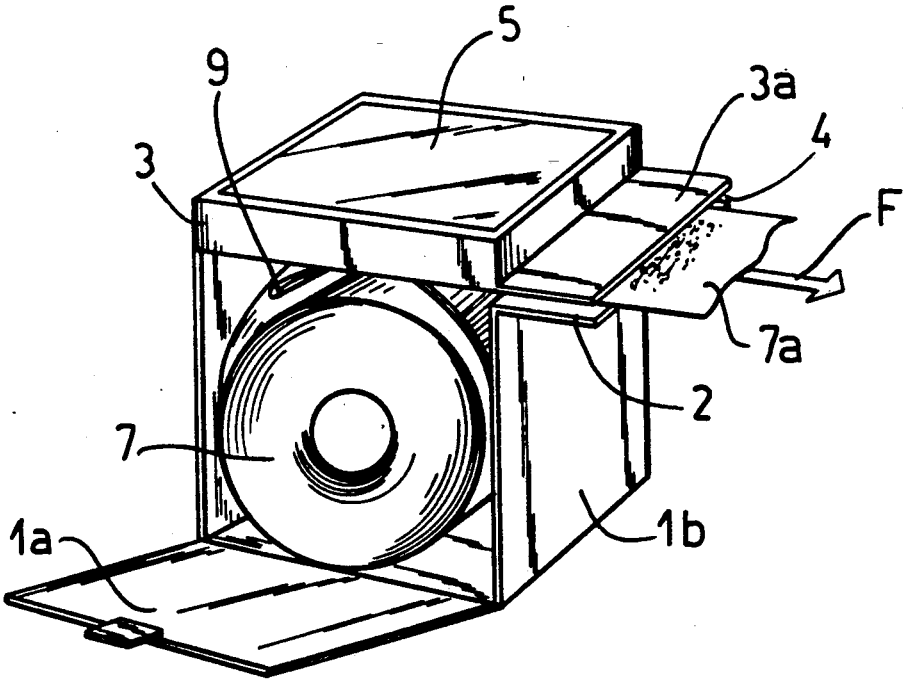
FIG. 4 is a perspective view of the distributor.

The strip of the paper roll 7 is inserted with its free end 7a between the pad 8 and the lower surface of the tray 5, in such a manner that the strip is pressed by the pad 8 against the product 5a contained in the tray 5. The free edge 7a is caused to pass through the slit 4 and is placed on the projecting flange 2 as shown in FIG. 4.

The front wall 1a may also be transparent, entirely or in part, and/or may be provided with an indicator for the contents.

With reference to the drawing, the method of functioning of the distributor for samples is now illustrated, in which the free edge 7a of the paper roll 7 is caused to emerge through the slit 4 by actuation until it projects from the slit 4 by an amount which can be gripped by the fingers of the hand of the user and further extracted by pulling it in the direction of arrow F (FIG. 4) in such a manner as to cause a determined quantity of strip to emerge from the slit 4 carrying the specimen of product 5a contained in the tray 5 and deposited on the paper strip 7 by action of the pad 8.

The quantity of strip 7, which can be discharged from the box by each pulling actuation, is determined by the fixed distance between successive pairs of holes 7c. In fact when the next pair of holes engages with the spherical surface of the studs 2c a resistant action is produced such as to cause tearing of the strip along the transverse prerupture lines 7b. In this way, at each pull the user will be able to tear off a predetermined quantity of strip, leaving available for the next user a new strip edge, just projecting from the slit 4 and therefore still hygienically uncontaminated.

Thus, the sample of product 5a contained in the tray 5 is placed at the disposal of the interested user, for all the tests which the user may desire to carry out, for example in addition to verifying its color, consistency, adherence or the like, it may be spread or checked in any manner with the certainty that the sample has not previously been in contact with other surfaces and is therefore free from any contamination.

Figure 5:
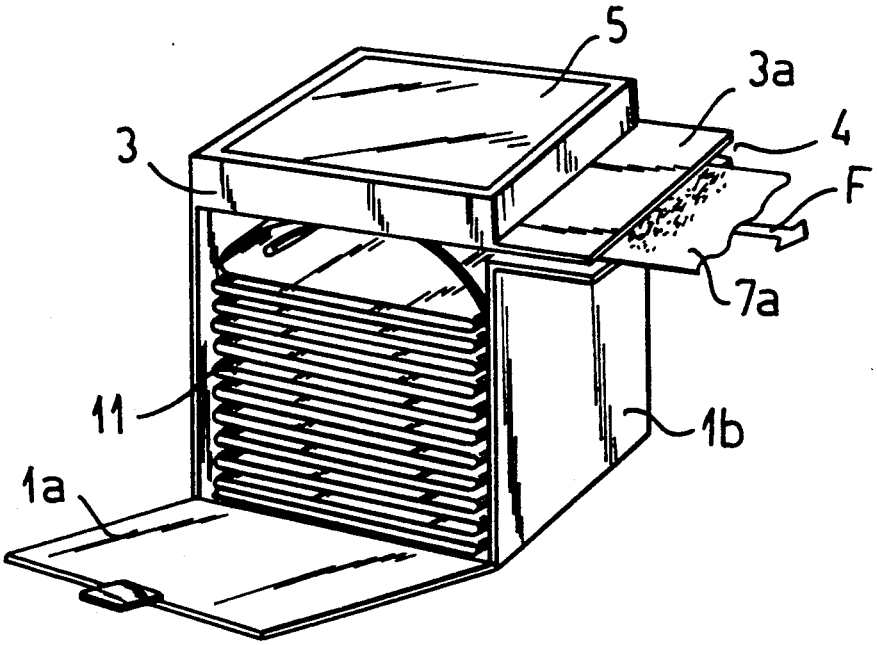
FIG. 5 is a perspective view of another embodiment of the distributor with a continuous strip of paper, but folded to form prerupture lines for napkins.
Figure 6:
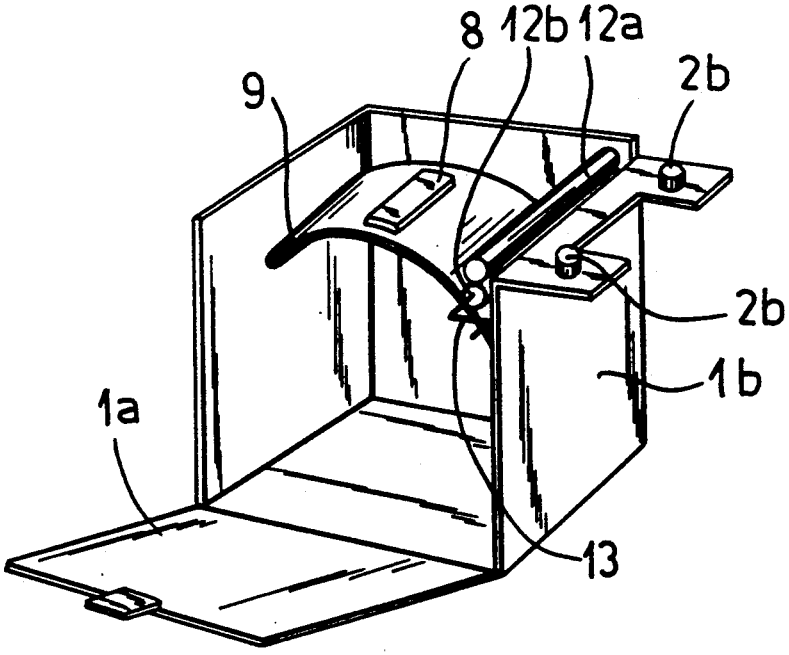
FIG. 6 is a perspective view of the distributor with a hand device for feed of the strip.

In an embodiment with reference to FIG. 5, there may be disposed inside the box 1 a continuous strip of paper or the like 11, folded with prerupture lines to form napkins or the like, of which the last napkin extracted 11a is at the disposal of the user to be pulled in the direction of arrow F outside the slit 4 with the sample of product: 5a at the disposal of the user.

According to this invention, the strip of paper or the napkin contained in the box may be preprinted with all the indications desired, for example type and/or number of product, place of origin, cost and the like, and also the information may be indicated above the transparent tray 5, where the product 5a is pressed in such a way that the user shall simultaneously have all the indications necessary for identifying the product contained in the sample extracted.

The distributor according to this invention may also be complemented by an actuation means which automatically causes the discharge from the slit 4 of portions of predetermined length of strip carrying the product. For example, there may be provided in the zone adjacent to the slit 4 a pair of rollers 12a and 12b, connected to a crank 13, which projects through the wall of the box; when the user executes a turn of the crank 13, the roller 12b entrains by friction a determined quantity of strip towards the outside.

The distributor described may also be disposed in appropriate containers, located at the disposal of the public in any desired place, also without supervision, the containers themselves being sealed and inaccessible.

I claim:

1. A dispensing assembly for cosmetics comprising: a housing provided with:

a plurality of side walls formed with respective upper and lower edges, a bottom wall bridging said lower edges of said side walls, one of said side walls being formed with a flange extending outwards from the respective upper edge of said one side wall, and a lid mounted on said upper edges of said side walls and provided with a respective flange extending parallel to and spaced above from said flange of said one side wall, said flanges forming a slit therebetween;

a transparent tray with cosmetics to be dispensed mounted on said housing and operatively connected with said lid, said tray being provided with means forming an aperture facing said bottom wall of said housing;

means in said housing for receiving a succession of interconnected sheets, each of said sheets having a respective outer face and a respective leading edge;

elastic means in said housing for guiding said sheets along a path thereof towards said slit; and a biasing element on said elastic means located along said path and extending upwardly toward said aperture of said tray, said outer face of the respective sheet receiving a sample of cosmetics upon passing over said biasing element and below said aperture with said biasing element urging the respective sheet against said aperture, so that said sample is delivered outside said housing upon pulling of said leading edge of the respective sheet from said slit.

2. The dispensing assembly defined in claim 1 wherein said flange extending from said upper edge of the respective side wall has a C shape and is provided with spaced apart and outwardly extending flanks, each of said flanks being formed with a respective stud extending upwardly towards said flange of said lid, each of said sheets being formed with a respective pair of holes engaging said studs for separating said sheets from one another.

3. The dispensing assembly defined in claim 1 wherein said sheets are perforated.

4. The dispensing assembly defined in claim 1 wherein said workpiece is a roll of strip paper.

5. The dispensing assembly defined in claim 1 wherein said workpiece is a plurality of folded napkins.

6. The dispensing assembly defined in claim 1 wherein another one of said side walls is a transparent door for replacing said workpiece.

7. The dispensing assembly defined in claim 1 wherein said lid is formed with means for receiving said transparent tray and including bulges registering with respective cut-back portions formed on said tray upon mounting thereof on said housing.

8. The dispensing assembly defined in claim 1, further comprising a pair of oppositely rotatable rollers mounted in said housing, said rollers being actuated by a lever connected thereto and projecting outside of said housing for delivering said sheets to said slit.

* * * * *